US007704339B2

(12) United States Patent
Voice et al.

(10) Patent No.: US 7,704,339 B2
(45) Date of Patent: Apr. 27, 2010

(54) METHOD OF HEAT TREATING TITANIUM ALUMINIDE

(75) Inventors: Wayne E Voice, Nottingham (GB); Dawei Hu, Birmingham (GB); Xinhua Wu, Birmingham (GB); Michael Loretto, Birmingham (GB)

(73) Assignee: Rolls-Royce plc, London (GB)

( * ) Notice: Subject to any disclaimer, the term of this patent is extended or adjusted under 35 U.S.C. 154(b) by 235 days.

(21) Appl. No.: 11/654,596

(22) Filed: Jan. 18, 2007

(65) Prior Publication Data

US 2007/0175551 A1 Aug. 2, 2007

(30) Foreign Application Priority Data

Jan. 27, 2006 (GB) ..... 0601662.0

(51) Int. Cl.
*C22F 1/18* (2006.01)
*C22C 14/00* (2006.01)

(52) U.S. Cl. ..... 148/669; 148/421; 420/418

(58) Field of Classification Search ..... 148/669, 148/421; 420/418
See application file for complete search history.

(56) References Cited

U.S. PATENT DOCUMENTS 4,842,817 A 6/1989 Shyh-Chin et al.
5,299,353 A 4/1994 Nazmy
H1659 H * 7/1997 Semiatin et al. ..... 148/669
5,653,828 A 8/1997 Zhao et al.
2004/0003877 A1* 1/2004 Hu ..... 148/669
2005/0081967 A1* 4/2005 Hu et al. ..... 148/669

FOREIGN PATENT DOCUMENTS

EP 1 378 582 A 1/2004
EP 1 507 017 A 2/2005
JP 6 116 691 AB 4/1994
JP 6 279 964 AB 10/1994

* cited by examiner

*Primary Examiner*—Roy King
*Assistant Examiner*—Caitlin Fogarty
(74) *Attorney, Agent, or Firm*—Jeffrey S. Melcher; Manelli Denison & Selter PLLC

(57) ABSTRACT

A gamma titanium aluminide alloy consisting of 46 at % aluminium, 8 at % tantalum and the balance titanium plus incidental impurities has an alpha transus temperature $T_\alpha$ between 1310° C. and 1320° C. The gamma titanium aluminide alloy was heated to a temperature $T_1$=1330° C. and was held at $T_1$=1330° C. for 1 hour or longer. The gamma titanium aluminide alloy was air cooled to ambient temperature to allow the massive transformation to go to completion. The gamma titanium aluminide alloy was heated to a temperature $T_2$=1250° C. to 1290° C. and was held at $T_2$ for 4 hours. The gamma titanium aluminide alloy was air cooled to ambient temperature. The gamma titanium aluminide alloy has a fine duplex microstructure comprising differently orientated alpha plates in a massively transformed gamma matrix. The heat treatment reduces quenching stresses and allows larger castings to be grain refined.

24 Claims, 2 Drawing Sheets

METHOD OF HEAT TREATING TITANIUM ALUMINIDE

FIELD OF THE INVENTION

The present invention relates to a method of heat-treating titanium aluminide and in particular to a method of heat-treating gamma titanium aluminide.

BACKGROUND OF THE INVENTION

There is a requirement to refine the microstructure of a titanium aluminide alloy, in particular cast titanium aluminide alloy, which does not involve hot working of the titanium aluminide alloy.

Our published European patent application EP1378582A1 discloses a method of heat-treating a titanium aluminide alloy having a single alpha phase field and being capable of producing a massively transformed gamma microstructure. In that method of heat-treating the titanium aluminide alloy is heated to a temperature above the alpha transus temperature, is maintained above the alpha transus temperature in the single alpha phase field for a predetermined time period, is cooled from the single alpha phase field to ambient temperature to produce a massively transformed gamma microstructure, is heated to a temperature below the alpha transus temperature in the alpha and gamma phase field, is maintained at the temperature below the alpha transus temperature for a predetermined time period to precipitate alpha plates in the massively transformed gamma microstructure such that a refined microstructure is produced and is then cooled to ambient temperature.

A problem with this heat-treatment is that the cooling, quenching, of the titanium aluminide from above the alpha transus to ambient temperature induces quenching stresses in the titanium aluminide. The quenching stresses may result in cracking of castings. A further problem is that the heat-treatment is only suitable for relatively thin castings.

Our published European patent application EP1507017A1 discloses a method of heat-treating a titanium aluminide alloy having a single alpha phase field and being capable of producing a massively transformed gamma microstructure. In that method of heat-treating the titanium aluminide alloy is heated to a temperature above the alpha transus temperature, is maintained above the alpha transus temperature in the single alpha phase field for a predetermined time period, is cooled from the single alpha phase field to a temperature in the range 900° C. to 1200° C. to produce a massively transformed gamma microstructure, is heated to a temperature below the alpha transus temperature in the alpha and gamma phase field, is maintained at the temperature below the alpha transus temperature for a predetermined time period to precipitate alpha plates in the massively transformed gamma microstructure such that a refined microstructure is produced and is then cooled to ambient temperature.

In this heat-treatment the cooling, quenching, of the titanium aluminide from above the alpha transus to a temperature in the range 900° C. to 1200° C. reduces quenching stresses in the titanium aluminide and hence reduces cracking of castings. The heat-treatment is suitable for thin castings and for thicker castings.

Cracking during cooling, quenching, from a temperature above the alpha transus temperature, is related to both cooling rate and the dimensions of the titanium aluminide castings. Generally, cracking is promoted by relatively high cooling rates and by relatively large dimension castings.

SUMMARY OF THE INVENTION

Accordingly the present invention seeks to provide a novel method of heat-treating titanium aluminide alloy which reduces, preferably overcomes, the above-mentioned problems.

Accordingly the present invention provides a method of heat-treating titanium aluminide alloy, the titanium aluminide alloy having a single alpha phase field and being capable of producing a massively transformed gamma microstructure, the titanium aluminide alloy comprising at least 45 at % aluminium, 0-6 at % niobium, 4-10 at % tantalum, niobium plus tantalum is less than or equal to 10 at % and the balance titanium and incidental impurities, the method comprising the steps of:

(a) heating a titanium aluminide alloy to a temperature above the alpha transus temperature, (b) maintaining the titanium aluminide alloy at a temperature above the alpha transus temperature in the single alpha phase field for a predetermined time period, (c) cooling the titanium aluminide alloy from the single alpha phase field to produce a massively transformed gamma microstructure, (d) heating the titanium aluminide to a temperature below the alpha transus temperature in the alpha and gamma phase field, (e) maintaining the titanium aluminide at the temperature below the alpha transus temperature for a predetermined time period to precipitate alpha plates in the massively transformed gamma microstructure such that a refined microstructure is produced, (f) cooling the titanium aluminide to ambient temperature.

Step (c) may comprise cooling the titanium aluminide alloy from the single alpha phase field to a temperature in the range of 900° C. to 1200° C. and maintaining the titanium aluminide alloy at the temperature in the range of 900° C. to 1200° C. for a predetermined time period to produce a massively transformed gamma microstructure.

Preferably the titanium aluminide alloy comprising at least 45 at % aluminium, 0-4 at % niobium, 4-8 at % tantalum, niobium plus tantalum is less than or equal to 8 at % and the balance titanium and incidental impurities.

Preferably step (c) comprises cooling the titanium aluminide to ambient temperature.

Preferably in step (b) the predetermined time period is up to 2 hours.

Preferably in step (e) the predetermined time period is up to 4 hours.

Preferably step (d) comprises heating the titanium aluminide alloy to a temperature about 30° C. to 60° C. below the alpha transus temperature.

Preferably step (a) comprises heating the titanium aluminide alloy to a temperature of about 20° C. to 30° C. above the alpha transus temperature.

Preferably step (f) comprises air-cooling or furnace cooling.

Step (c) may comprise fluidised bed cooling or salt bath cooling. There may be a step of cooling the titanium aluminide to ambient temperature after step (c) and before step (d).

Preferably the titanium aluminide is cooled to ambient temperature by air-cooling or oil cooling.

The titanium aluminide alloy may comprise 46 at % aluminium, 4 at % tantalum, 4 at % niobium and the balance titanium and incidental impurities.

The alpha transus temperature is about 1340° C., step (a) comprises heating to a temperature of 1360° C., step (b)

comprises maintaining the titanium aluminide alloy at a temperature of about 1360° C. for about 1 hour, step (c) comprises salt bath, or fluidised bed, cooling the titanium aluminide alloy from a temperature of 1360° C. to a temperature between 900° C. and 1200° C. and maintaining the titanium aluminide alloy at the temperature in the range of 900° C. to 1200° C. for a predetermined time period to produce a massively transformed gamma microstructure, steps (d) and (e) comprise heating the titanium aluminide alloy to a temperature of 1280° C. to 1310° C. for about 2 hours to precipitate alpha plates in the massively transformed gamma microstructure such that a refined microstructure is produced in the titanium aluminide alloy, and step (f) comprises air cooling the titanium aluminide alloy to ambient temperature.

The alpha transus temperature is about 1340° C., step (a) comprises heating to a temperature of 1360° C., step (b) comprises maintaining the titanium aluminide alloy at a temperature of about 1360° C. for about 1 hour, step (c) comprises air cooling the titanium aluminide alloy from a temperature of 1360° C. to ambient temperature to produce a massively transformed gamma microstructure, steps (d) and (e) comprise heating the titanium aluminide alloy to a temperature of 1280° C. to 1310° C. for about 2 hours to precipitate alpha plates in the massively transformed gamma microstructure such that a refined microstructure is produced in the titanium aluminide alloy, and step (f) comprises air cooling the titanium aluminide alloy to ambient temperature.

Step (c) may comprise cooling the titanium aluminide at a cooling rate of 15° $C.S^{-1}$ to 150° $C.S^{-1}$. Preferably step (c) comprises cooling the titanium aluminide at a cooling rate of 15° $C.S^{-1}$ to 20° $C.S^{-1}$.

Preferably the titanium aluminide alloy comprises 46 at % aluminium, 8 at % tantalum and the balance titanium and incidental impurities.

The alpha transus temperature is between 1310° C. and 1320° C., step (a) comprises heating to a temperature of 1330° C., step (b) comprises maintaining the titanium aluminide alloy at a temperature of about 1330° C. for about 1 hour, step (c) comprise salt bath cooling, or fluidised bed cooling, the titanium aluminide alloy from a temperature of 1330° C. to a temperature between 900° C. and 1200° C. and maintaining the titanium aluminide alloy at the temperature in the range of 900° C. to 1200° C. for a predetermined time period to produce a massively transformed gamma microstructure, steps (d) and (e) comprise heating the titanium aluminide alloy to a temperature of about 1250° C. to about 1290° C. for about 4 hours to precipitate alpha plates in the massively transformed gamma microstructure such that a refined microstructure is produced in the titanium aluminide alloy, and step (f) comprises air cooling the titanium aluminide alloy to ambient temperature.

The alpha transus temperature is between 1310° C. and 1320° C., step (a) comprises heating to a temperature of 1330° C., step (b) comprises maintaining the titanium aluminide alloy at a temperature of about 1330° C. for about 1 hour, step (c) comprise air cooling the titanium aluminide alloy from a temperature of 1330° C. to ambient temperature to produce a massively transformed gamma microstructure, steps (d) and (e) comprise heating the titanium aluminide alloy to a temperature of about 1250° C. to about 1290° C. for about 4 hours to precipitate alpha plates in the massively transformed gamma microstructure such that a refined microstructure is produced in the titanium aluminide alloy, and step (f) comprises air cooling the titanium aluminide alloy to ambient temperature.

Preferably step (c) comprises cooling the titanium aluminide at a cooling rate of 4° $C.S^{-1}$ to 150° $C.S^{-1}$. Preferably step (c) comprises cooling the titanium aluminide at a cooling rate of 4° $C.S^{-1}$ to 20° $C.S^{-1}$. Preferably the titanium aluminide alloy is a cast titanium aluminide component.

Preferably the method comprises hot isostatic pressing of the cast titanium aluminide alloy component.

Preferably the hot isostatic pressing of the cast titanium aluminide alloy component is concurrent with step (e).

Preferably the hot isostatic pressing comprises applying a pressure of about 150 MPa for about 4 hours.

Preferably the titanium aluminide alloy is a compressor blade or a compressor vane.

BRIEF DESCRIPTION OF THE DRAWINGS

The present invention will be more fully described by way of example with reference to the accompanying drawings in which.

DETAILED DESCRIPTION OF THE INVENTION

As mentioned previously there is a problem of cracking of cast gamma titanium aluminide alloys during heat treatment. The cracking is related to cooling rate and the dimensions of the casting. It is believed that a gamma titanium aluminide alloy consisting of 46 at % aluminium, 8 at % niobium and the balance titanium plus incidental impurities cooled at a rate of 20° $C.s^{-1}$ to 300° $C.s^{-1}$ produces a massively transformed gamma structure. It is believed for a titanium aluminide alloy consisting of 46 at % aluminium, 8 at % niobium and the balance titanium plus incidental impurities that cracking is evident for cooling rates of greater than or equal to 40° $C.s^{-1}$ from a temperature above the alpha transus temperature and no cracking is evident for cooling rates of less than or equal to 25° $C.s^{-1}$ from a temperature above the alpha transus temperature for 20 mm diameter rods.

Figure 1:
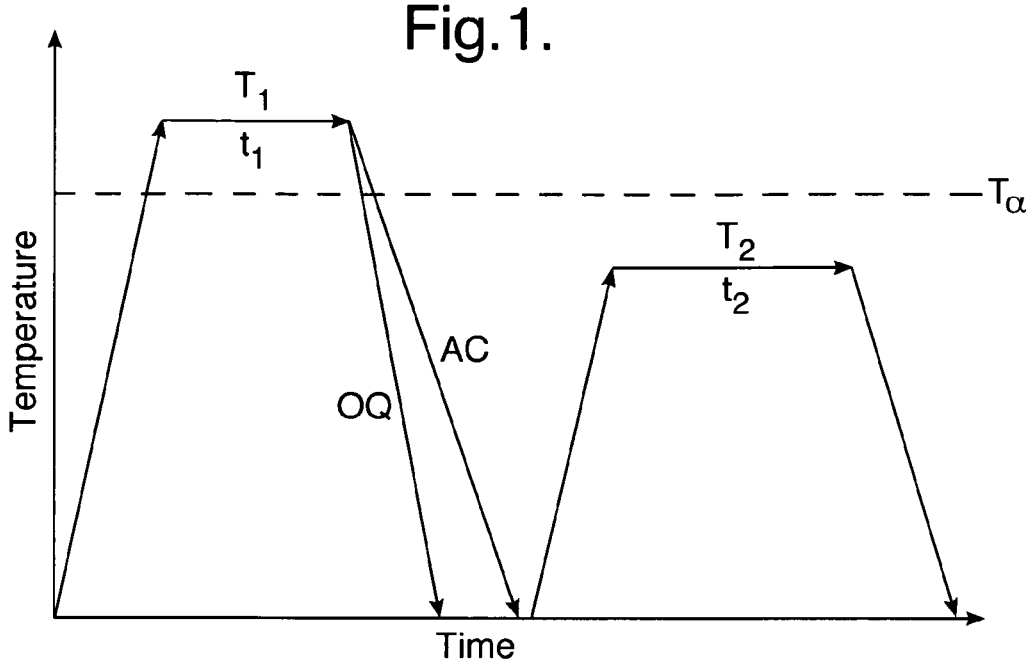
FIG. 1 is graph of temperature versus time illustrating a method of heat-treating a titanium aluminide alloy according to the present invention.

A method of heat-treating a titanium aluminide alloy according to the present invention is described with reference to FIG. 1. The present invention is concerned with heat-treating gamma titanium aluminide alloys with at least 46 at % aluminium, 8 at % tantalum and a single alpha phase field.

The heat treatment process comprises heating the gamma titanium aluminide to a temperature $T_1$ above the alpha transus temperature $T_\alpha$. The gamma titanium aluminide alloy is then maintained at a temperature $T_1$ above the alpha transus temperature $T_\alpha$ in the single alpha phase field for a predetermined time period $t_1$. The gamma titanium aluminide alloy is quenched, for example air cooled, or oil cooled, from the single alpha phase field at temperature $T_1$ to ambient temperature to produce a massively transformed gamma microstructure. The gamma titanium aluminide alloy is then heated to a temperature $T_2$ below the alpha transus temperature $T_\alpha$. The gamma titanium aluminide alloy is maintained at the temperature $T_2$ in the alpha and gamma phase field for a predetermined time period $t_2$ to precipitate alpha plates in the massively transformed gamma microstructure such that a refined microstructure is produced in the titanium aluminide alloy. The gamma titanium aluminide alloy is cooled, for example air cooled, or furnace cooled, to ambient temperature.

In particular, the gamma titanium aluminide alloy is heated to a temperature $T_1$ about 20° C. to 30° C. above the alpha transus temperature $T_\alpha$. The gamma titanium aluminide alloy is maintained at the temperature $T_1$ for up to 2 hours. The gamma titanium aluminide alloy is then quenched, for example air cooled, or oil cooled, at a rate sufficient to induce a massively transformed gamma microstructure. The gamma titanium aluminide alloy is heated to a temperature $T_2$ about 30° C. to 60° C. below the alpha transus temperature $T_\alpha$. The gamma titanium aluminide alloy is maintained at the temperature $T_2$ for up to 4 hours to precipitate fine alpha plates with different orientations in the massively transformed gamma microstructure due to the massive gamma to alpha+gamma phase transformation. This gives rise to a very fine duplex microstructure. The differently orientated alpha plates precipitated in the massive gamma phase matrix effectively reduce the grain size of the gamma titanium aluminide. The gamma titanium aluminide alloy is then cooled, for example air cooled, or furnace cooled, to ambient temperature.

The holding at temperature $T_1$ for a time period $t_1$ also acts a homogenisation process for cast titanium aluminide alloys.

Example 1

A gamma titanium aluminide alloy consisting of 46 at % aluminium, 8 at % tantalum and the balance titanium plus incidental impurities was heat treated according to the present invention. This gamma titanium aluminide alloy has an alpha transus temperature $T_\alpha$ between 1310° C. and 1320° C. This gamma titanium aluminide alloy was heat treated to a temperature $T_1$ of 1330° C. and was held at 1330° C. for 1 hour. The gamma titanium aluminide alloy was air cooled to ambient temperature. The gamma titanium aluminide alloy was heated to a temperature $T_2$=1280° C. and was held at a temperature between 1250° C. and 1290° C. for 4 hours. The gamma titanium aluminide alloy was air cooled to ambient temperature.

It is believed that for a gamma titanium aluminide alloy consisting of 46 at % aluminium, 8 at % tantalum and the balance titanium plus incidental impurities cooled at a rate of 4° $C.s^{-1}$ to 150° $C.s^{-1}$ produces a massively transformed gamma structure. The addition of tantalum to the gamma titanium aluminide alloy results in a shift of the massive gamma transformation to longer time periods, e.g. slower cooling rates compared to that for gamma titanium aluminide alloy with niobium.

Example 2

In order to assess the extent of the massive transformation that can be accomplished by air cooling, so that quench cracking can be avoided during cooling from a temperature above the alpha transus temperature, rods of gamma titanium aluminide alloy, consisting of 46 at % aluminium, 8 at % tantalum and the balance titanium plus incidental impurities with different dimensions were prepared. The rods had dimensions of 15 mm diameter×20 mm, 20 mm diameter×35 mm and 25 mm diameter×50 mm. The rods were heated to a temperature $T_1$ of 1330° C. and were held at 1330° C. for 1 hour. The gamma titanium aluminide alloy samples were air cooled to ambient temperature. The 15 mm diameter×20 mm sample was dominated by massive gamma formation with very limited fine lamellae at previous grain boundaries. In the 20 mm diameter by 35 mm sample the structure consists mainly of massive gamma formation with slightly more fine lamellae at grain boundaries. The 25 mm diameter×50 mm sample still had massive gamma formation in over 90% of the sample but with greater amounts of fine lamellae at the grain boundaries.

The 20 mm diameter samples were air cooled at rates of 9° $C.s^{-1}$ and 5° $C.s^{-1}$ without cracking of the samples. The 15 mm diameter samples were also air cooled at rates of 9° $C.s^{-1}$ and 5° $C.s^{-1}$ without cracking of the samples.

Thus the titanium aluminide may be cooled at a cooling rate of 4° $C.S^{-1}$ to 20° $C.S^{-1}$ to produce the massive gamma formation without cracking.

Figure 2:
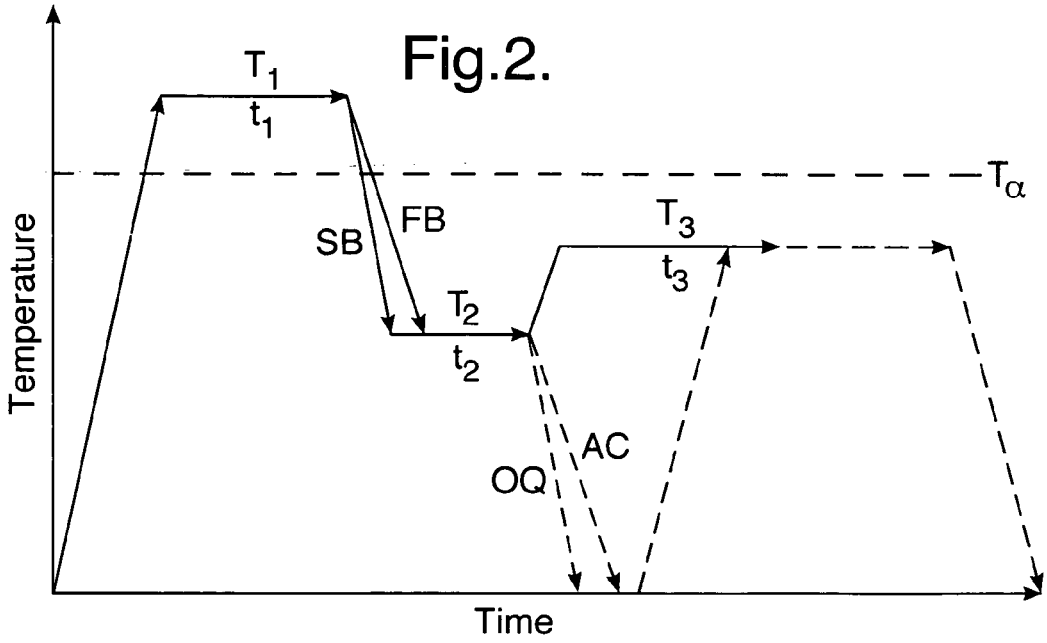
FIG. 2 is a graph of temperature versus time illustrating another method of heat-treating a titanium aluminide alloy according to the present invention.

Another method of heat-treating a titanium aluminide alloy according to the present invention is described with reference to FIG. 2. The present invention is concerned with heat-treating gamma titanium aluminide alloys with at least 46 at % aluminium, 8 at % tantalum and a single alpha phase field.

The heat treatment process comprises heating the gamma titanium aluminide to a temperature $T_1$ above the alpha transus temperature $T_\alpha$. The gamma titanium aluminide alloy is then maintained at a temperature $T_1$ above the alpha transus temperature $T_\alpha$ in the single alpha phase field for a predetermined time period $t_1$. The gamma titanium aluminide alloy is quenched, for example fluidised bed cooled, or salt bath cooled, from the single alpha phase field at temperature $T_1$ to a temperature $T_2$. The gamma titanium aluminide alloy is maintained at a temperature $T_2$ for a predetermined time period $t_2$ to produce a massively transformed gamma microstructure. The gamma titanium aluminide alloy is then heated to a temperature $T_3$ below the alpha transus temperature $T_\alpha$. The gamma titanium aluminide alloy is maintained at the temperature $T_3$ in the alpha and gamma phase field for a predetermined time period $t_3$ to precipitate alpha plates in the massively transformed gamma microstructure such that a refined microstructure is produced in the titanium aluminide alloy. The gamma titanium aluminide is cooled, for example air cooled, or furnace cooled, to ambient temperature.

In particular, the gamma titanium aluminide is heated to a temperature $T_1$ about 20° C. to 30° C. above the alpha transus temperature $T_\alpha$. The gamma titanium aluminide alloy is maintained at the temperature $T_1$ for up to 2 hours. The gamma titanium aluminide alloy is then quenched, for example fluidised bed cooled, or salt bath cooled, to a temperature $T_2$ about 900° C. to 1200° C. and maintained for a predetermined time period to induce a massively transformed gamma microstructure. The gamma titanium alloy is heated to a temperature $T_3$ 30° C. to 60° C. below the alpha transus temperature $T_\alpha$. The gamma titanium aluminide alloy is maintained at the temperature $T_3$ for up to 4 hours to precipitate fine alpha plates with different orientations in the massively transformed gamma microstructure due to the massive gamma to alpha+gamma phase transformation. This gives rise to a very fine duplex microstructure. The differently orientated alpha plates precipitated in the massive gamma phase matrix effectively reduce the grain size of the gamma titanium aluminide. The gamma titanium aluminide alloy is then cooled, for example air cooled, or furnace cooled, to ambient temperature.

The holding at temperature $T_1$ for a time period $t_1$ also acts a homogenisation process for cast titanium aluminide alloys.

As an alternative the gamma titanium aluminide alloy is air-cooled or oil cooled from temperature $T_2$ to ambient temperature before the gamma titanium aluminide alloy is heated to the temperature $T_3$.

The use of the salt bath cooling or fluidised bed cooling enables thicker castings to be produced without cracking.

The present invention is applicable generally to gamma titanium aluminide alloys consisting of at least 45 at % aluminium, 0-6 at % niobium, 4-10 at % tantalum, niobium plus tantalum is less than or equal to 10 at % and the balance is titanium plus incidental impurities. Preferably the titanium aluminide alloy consisting at least 45 at % aluminium, 0-4 at % niobium, 4-8 at % tantalum, niobium plus tantalum is less than or equal to 8 at % and the balance titanium and incidental impurities. The gamma titanium aluminide alloy must have a single alpha phase field, the alloy must have a massive phase transformation normally requiring a high aluminium concentration and the alloy must have low kinetics in its continuous cooling phase transformation in order to reduce the required cooling rate to just an air cool.

The present invention is applicable to a gamma titanium aluminide alloy consisting of 46 at % aluminium, 4 at % niobium, 4 at % tantalum and the balance titanium plus incidental impurities. This gamma titanium aluminide alloy has an alpha transus temperature $T_\alpha$ of 1340° C. and for example is heated to a temperature of 1360° C. for 1 hour, then cooled to ambient temperature or a temperature between 900° C. and 1200° C. and then heated to a temperature between 1280° C. and 1310° C. for 4 hours. The gamma titanium aluminide is cooled from a temperature above the alpha transus temperature $T_\alpha$ at a cooling rate of 15° $C.S^{-1}$ to 150° $C.S^{-1}$.

Thus the titanium aluminide may be cooled at a cooling rate of 15° $C.S^{-1}$ to 20° $C.S^{-1}$ to produce the massive gamma formation without cracking.

The advantages of the present invention are that the heat-treatment is suitable for relatively thin castings and for larger castings so that they all have improved ductility and high strength. In particular the heat treatment produces the massively transformed gamma by cooling at lower cooling rates, and this enables the gamma titanium aluminide alloy to be grain refined with reduced likelihood of cracking. The ease of application of the air cooling and ageing process gives a strong, ductile gamma titanium aluminide alloy. The ability to soak in the single alpha phase field with an unrestricted holding time allows this process to be carried out in normal heat treatment furnaces and it also acts as a homogenisation treatment when applied to cast gamma titanium aluminide alloys. The ageing temperature window is wide enough and far away from the alpha transus temperature to make an acceptable technical requirement of the heat treatment furnace together with easy operation. It is believed that the lower level of aluminium may be 45 at % and possibly 44 at %. Thus, the present invention provides a heat treatment for gamma titanium aluminide alloy components, which provides grain refinement. It is particularly suitable for relatively large and complex shaped cast components where the previous heat treatment would induce high residual stresses and possibly cracking of the gamma titanium aluminide alloy components. The heat treatment also permits grain refinement throughout relatively large and complex shaped components rather than just the surface regions of the component.

It may be possible to heat the titanium aluminide alloy component to a temperature of about 1300° C. and to maintain the titanium aluminide alloy component at about 1300° C. to allow the temperature to equilibrate in the titanium aluminide alloy component so that the titanium aluminide alloy component needs to be maintained at temperature $T_1$ for a shorter time period.

In the case of cast gamma titanium aluminide alloy components it may be necessary to remove porosity from the cast gamma titanium aluminide alloy component. In this case the cast gamma titanium aluminide alloy component may be hot isostatically pressed (HIP) to remove the porosity. The hot isostatic pressing preferably occurs at the same time as the heat treatment temperature $T_2$ and for the time period of about 4 hours at a pressure of about 150 MPa and this is beneficial because this dispenses with the requirement for a separate hot isostatic pressing step.

Figure 3:
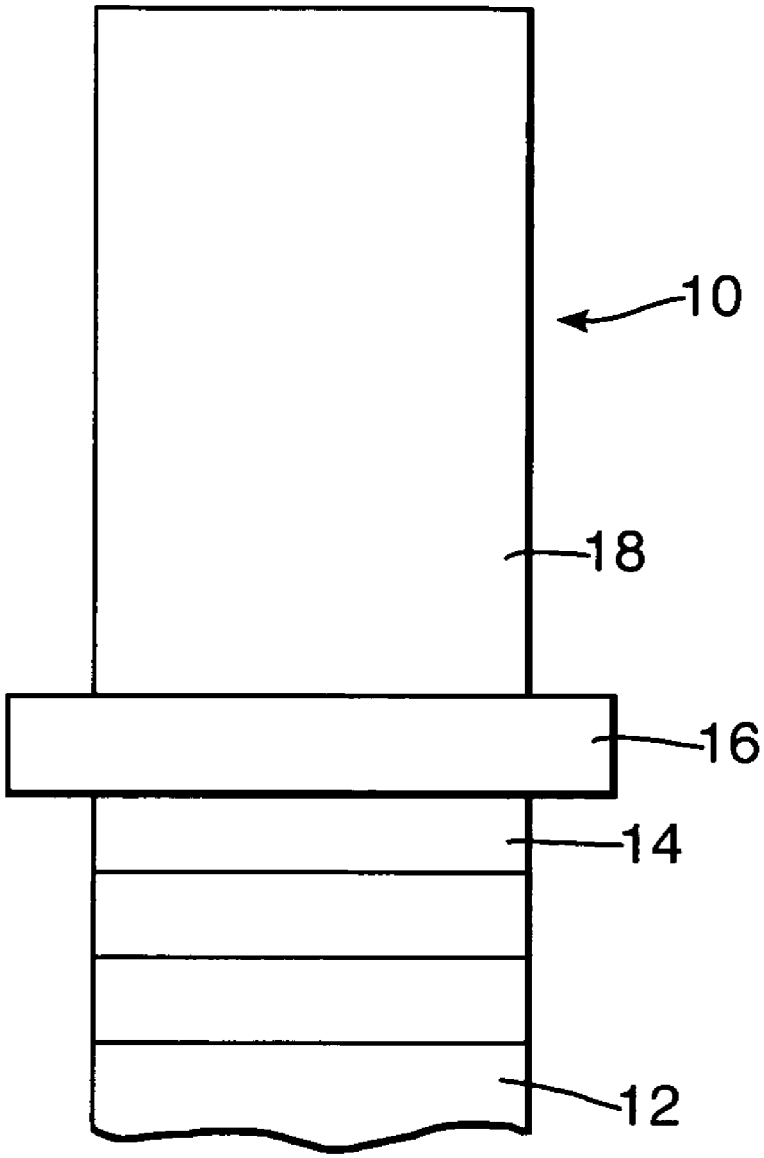
FIG. 3 is a gamma titanium aluminide alloy gas turbine engine compressor blade heat treated according to the present invention.

The present invention is particularly suitable for gamma titanium aluminide gas turbine engine compressor blades as illustrated in FIG. 3. The compressor blade 10 comprises a root 12, a shank 14, a platform 16 and an aerofoil 18. The present invention is also suitable for gamma titanium aluminide gas turbine engine compressor vanes or other gamma titanium aluminide gas turbine engine components. The present invention may also be suitable for gamma titanium aluminide components for other engine, machines or applications.

The invention claimed is:

1. A method of heat-treating titanium aluminide alloy, the titanium aluminide alloy having a single alpha phase field and being capable of producing a massively transformed gamma microstructure, the titanium aluminide alloy comprises at least 45 at % aluminium, 0-6 at % niobium, 4-10 at % tantalum, niobium plus tantalum is less than or equal to 10 at % and the balance titanium and incidental impurities, the method comprising the steps of:

(a) heating a titanium aluminide alloy to a temperature above the alpha transus temperature, (b) maintaining the titanium aluminide alloy at a temperature above the alpha transus temperature in the single alpha phase field for a predetermined time period, (c) cooling the titanium aluminide alloy at a cooling rate of 4° $C.s^{-1}$ to 20° $C.s^{-1}$ from the single alpha phase field to produce a massively transformed gamma microstructure, (d) heating the titanium aluminide to a temperature below the alpha transus temperature in the alpha and gamma phase field, (e) maintaining the titanium aluminide at the temperature below the alpha transus temperature for a predetermined time period to precipitate alpha plates in the massively transformed gamma microstructure such that a refined microstructure is produced, (f) cooling the titanium aluminide to ambient temperature.

2. A method as claimed in claim 1 wherein the titanium aluminide alloy comprising at least 45 at % aluminium, 0-4 at % niobium, 4-8 at % tantalum, niobium plus tantalum is less than or equal to 8 at % and the balance titanium and incidental impurities.

3. A method as claimed in claim 1 wherein step (c) comprises cooling the titanium aluminide alloy from the single alpha phase field to a temperature in the range of 900° C. to 1200° C. and maintaining the titanium aluminide alloy at the temperature in the range of 900° C. to 1200° C. for a predetermined time period to produce a massively transformed gamma microstructure.

4. A method as claimed in claim 1 wherein step (c) comprises cooling the titanium aluminide to ambient temperature.

5. A method as claimed in claim 1, wherein in step (b) the predetermined time period is up to 2 hours.

6. A method as claimed in claim 1 wherein in step (e) the predetermined time period is up to 4 hours.

7. A method as claimed in claim 1 wherein step (d) comprises heating the titanium aluminide alloy to a temperature about 30° C. to 60° C. below the alpha transus temperature.

8. A method as claimed in claim 1 wherein step (a) comprises heating the titanium aluminide alloy to a temperature of about 20° C. to 30° C. above the alpha transus temperature.

9. A method as claimed in claim 1 wherein step (f) comprises air-cooling or furnace cooling.

10. A method as claimed in claim 3 wherein step (c) comprises fluidised bed cooling or salt bath cooling.

11. A method as claimed in claim 10 comprising cooling the titanium aluminide to ambient temperature after step (c) and before step (d).

12. A method as claimed in claim 1 wherein the titanium aluminide is cooled to ambient temperature by air-cooling or oil cooling.

13. A method as claimed in claim 1 wherein the titanium aluminide alloy comprises 46 at % aluminium, 4 at % tantalum, 4 at % niobium and the balance titanium and incidental impurities.

14. A method as claimed in claim 13 wherein the alpha transus temperature is about 1340° C., step (a) comprises heating to a temperature of 1360° C., step (b) comprises maintaining the titanium aluminide alloy at a temperature of about 1360° C. for about 1 hour, step (c) comprises salt bath, or fluidised bed, cooling the titanium aluminide alloy from a temperature of 1360° C. to a temperature between 900° C. and 1200° C. and maintaining the titanium aluminide alloy at the temperature in the range of 900° C. to 1200° C. for a predetermined time period to produce a massively transformed gamma microstructure, steps (d) and (e) comprise heating the titanium aluminide alloy to a temperature of 1280° C. to 1310° C. for about 2 hours to precipitate alpha plates in the massively transformed gamma microstructure such that a refined microstructure is produced in the titanium aluminide alloy, and step (f) comprises air cooling the titanium aluminide alloy to ambient temperature.

15. A method as claimed in claim 13 wherein the alpha transus temperature is about 1340° C., step (a) comprises heating to a temperature of 1360° C., step (b) comprises maintaining the titanium aluminide alloy at a temperature of about 1360° C. for about 1 hour, step (c) comprises air cooling the titanium aluminide alloy from a temperature of 1360° C. to ambient temperature to produce a massively transformed gamma microstructure, steps (d) and (e) comprise heating the titanium aluminide alloy to a temperature of 1280° C. to 1310° C. for about 2 hours to precipitate alpha plates in the massively transformed gamma microstructure such that a refined microstructure is produced in the titanium aluminide alloy, and step (f) comprises air cooling the titanium aluminide alloy to ambient temperature.

16. A method as claimed in claim 1 wherein the titanium aluminide alloy comprises 46 at % aluminium, 8 at % tantalum and the balance titanium and incidental impurities.

17. A method as claimed in claim 16 wherein the alpha transus temperature is between 1310° C. and 1320° C., step (a) comprises heating to a temperature of 1330° C., step (b) comprises maintaining the titanium aluminide alloy at a temperature of about 1330° C. for about 1 hour, step (c) comprise salt bath cooling, or fluidised bed cooling, the titanium aluminide alloy from a temperature of 1330° C. to a temperature between 900° C. and 1200° C. and maintaining the titanium aluminide alloy at the temperature in the range of 900° C. to 1200° C. for a predetermined time period to produce a massively transformed gamma microstructure, steps (d) and (e) comprise heating the titanium aluminide alloy to a temperature of about 1250° C. to about 1290° C. for about 4 hours to precipitate alpha plates in the massively transformed gamma microstructure such that a refined microstructure is produced in the titanium aluminide alloy, and step (f) comprises air cooling the titanium aluminide alloy to ambient temperature.

18. A method as claimed in claim 16 wherein the alpha transus temperature is between 1310° C. and 1320° C., step (a) comprises heating to a temperature of 1330° C., step (b) comprises maintaining the titanium aluminide alloy at a temperature of about 1330° C. for about 1 hour, step (c) comprise air cooling the titanium aluminide alloy from a temperature of 1330° C. to ambient temperature to produce a massively transformed gamma microstructure, steps (d) and (e) comprise heating the titanium aluminide alloy to a temperature of about 1250° C. to about 1290° C. for about 4 hours to precipitate alpha plates in the massively transformed gamma microstructure such that a refined microstructure is produced in the titanium aluminide alloy, and step (f) comprises air cooling the titanium aluminide alloy to ambient temperature.

19. A method as claimed in claim 13 wherein step (c) comprises cooling the titanium aluminide at a cooling rate of 15° $C.s^{-1}$ to 20° $C.s^{-1}$.

20. A method as claimed in claim 1 wherein the titanium aluminide alloy is a cast titanium aluminide component.

21. A method as claimed in claim 20 wherein comprising hot isostatic pressing of the cast titanium aluminide alloy component.

22. A method as claimed in claim 21 wherein the hot isostatic pressing of the cast titanium aluminide alloy component is concurrent with step (e).

23. A method as claimed in claim 21 wherein the hot isostatic pressing comprises applying a pressure of about 150 MPa for about 4 hours.

24. A method as claimed in claim 1 wherein the titanium aluminide alloy is a compressor blade or a compressor vane.

* * * * *